US005666047A

United States Patent [19]

Johnson et al.

[11] Patent Number: 5,666,047

[45] Date of Patent: Sep. 9, 1997

[54] DIELECTRIC TRANSFORMER

[75] Inventors: Leopold J. Johnson, Valley Center; Russell E. Hammond, San Diego, both of Calif.

[73] Assignee: The United States of America as represented by the Secretary of the Navy, Washington, D.C.

[21] Appl. No.: 539,643

[22] Filed: Oct. 5, 1995

[51] Int. Cl.[6] ..... H01F 27/40

[52] U.S. Cl. ..... 323/359

[58] Field of Search ..... 323/355–359; 363/44–48; 336/69, 122, 83, 183; 333/174–185; 324/123 R, 126, 127, 133, 99 R

[56] References Cited

U.S. PATENT DOCUMENTS

| | | | |
|---|---|---|---|
| 4,008,427 | 2/1977 | Johnson . | |
| 4,074,193 | 2/1978 | Kohler | 324/126 |
| 4,219,791 | 8/1980 | Moore et al. . | |
| 4,274,046 | 6/1981 | Harrison | 323/355 |
| 4,500,832 | 2/1985 | Mickiewicz | 323/340 |
| 4,581,573 | 4/1986 | Dobsa et al. | 323/356 |
| 4,684,882 | 8/1987 | Blain | 323/356 |
| 4,721,900 | 1/1988 | Kerfoot et al. | 323/356 |
| 4,760,325 | 7/1988 | Suzuki et al. | 323/355 |
| 4,978,826 | 12/1990 | DeRuiter et al. | 219/10.81 |
| 5,093,613 | 3/1992 | Diepenmaat | 323/356 |
| 5,126,714 | 6/1992 | Johnson | 336/83 |

*Primary Examiner*—Aditya Krishnan

*Attorney, Agent, or Firm*—Harvey Fendelman; Michael A. Kagan; Eric James Whitesell

[57] ABSTRACT

A dielectric power transformer comprises a tuning inductor having a nonmagnetic core connected in parallel with a capacitive voltage divider. The dielectric power transformer transforms the voltage of an alternating current power source connected across the inductor into a voltage across a load connected to the capacitive voltage divider. The dielectric power transformer has a resonant frequency substantially equal to the frequency of the power source.

7 Claims, 3 Drawing Sheets

DIELECTRIC TRANSFORMER

BACKGROUND OF THE INVENTION

The present invention relates to electrical voltage transformers. More specifically, but without limitation thereto, the present invention relates to a dielectric power transformer for low-loss power conversion at frequencies beyond around 2 MHZ.

Current digital logic circuits operate at lower voltages and must attenuate higher frequency voltage transients than circuits of earlier designs. Suitable power supplies for the newer digital circuits may operate in the range of 2–100 MHZ. However, current approaches are limited by the properties of magnetic transformers. Magnetic transformers become inefficient beyond around 2 MHZ because current magnetic core materials tend to be too lossy at the higher frequencies, and because leakage inductance increases with frequency as the cube of the frequency. Nonmagnetic core transformers may be used to reduce power losses, but nonmagnetic core transformers exhibit voltage droop with changes in the load due to insufficient coupling of the primary to the secondary.

An example of a transformer suitable for nonmagnetic cores is U.S. Pat. No. 4,274,046 by Harrison. This transformer comprises a series of pi-type or T-type sections. A disadvantage of this approach is that multiple inductors are required for the several pi or T sections. Another disadvantage is that a short circuit in the load results in a zero input impedance to the power source.

A need therefore exists for a power transformer that is efficient at higher frequencies in the range of about 2–100 MHZ.

SUMMARY OF THE INVENTION

The dielectric power transformer of the present invention is directed to overcoming the problems described above, and may provide further related advantages. The presently preferred embodiment in the following description of a dielectric power transformer does not preclude other embodiments and advantages of the present invention that may exist or become obvious to those skilled in the art.

The dielectric power transformer of the present invention comprises a tuning inductor with a nonmagnetic core connected in parallel with a capacitive voltage divider. The dielectric power transformer transforms the voltage of an alternating current power source connected across the inductor into a voltage across a load connected to the capacitive voltage divider. The dielectric power transformer has a resonant frequency substantially equal to the frequency of the power source.

An advantage of the dielectric power transformer is that power losses in the transformer are much less at higher frequencies than in comparable magnetic transformers.

Another advantage is that the load may be DC-isolated from the power source.

Yet another advantage of the dielectric power transformer is that the power source is protected from overload due to a short circuit in the load.

Still another advantage is that electrical currents having frequencies other than the resonant frequency of the dielectric transformer are suppressed, resulting in lower EMI radiation.

The features and advantages summarized above in addition to other aspects of the present invention will become more apparent from the description, presented in conjunction with the following drawings.

DESCRIPTION OF THE INVENTION

The following description is presented solely for the purpose of disclosing how the present invention may be made and used. The scope of the invention is defined by the claims.

Figure 1:
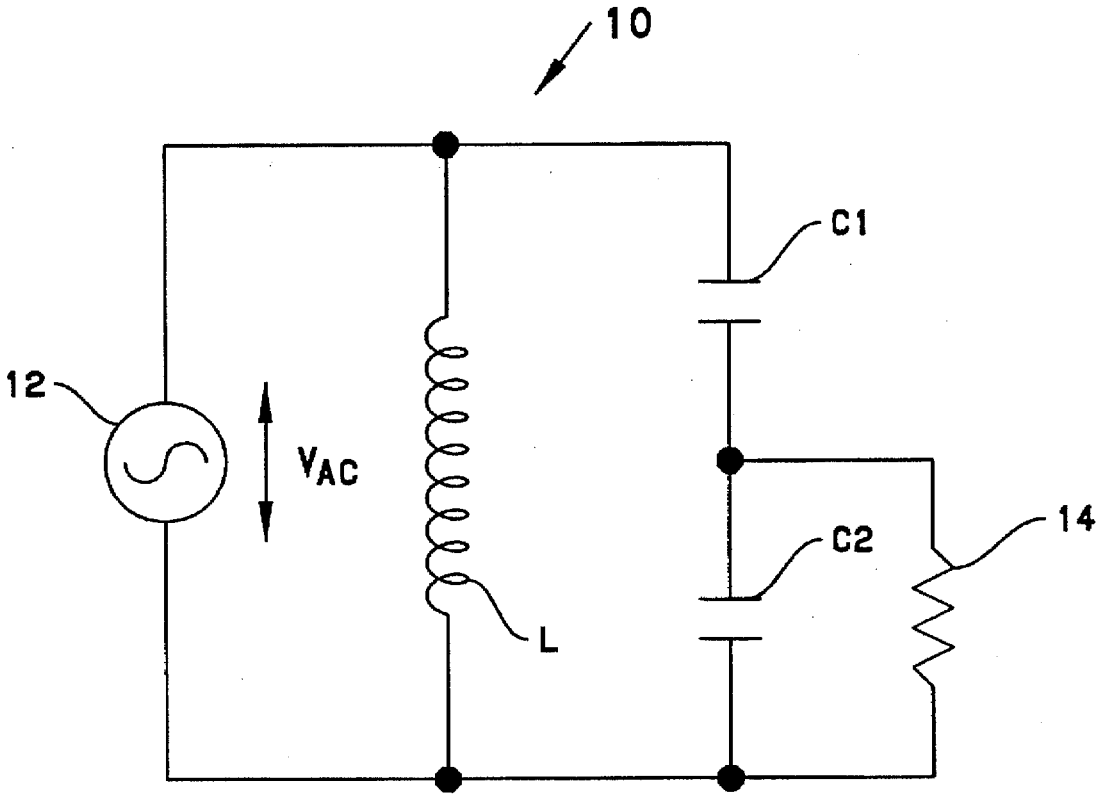
FIG. 1 is an electrical schematic of a voltage step-down dielectric power transformer.

In FIG. 1, a dielectric power transformer 10 for stepping down voltage comprises an inductor L having a nonmagnetic core connected in series with voltage divider capacitors C1 and C2. An alternating current power source 12 is connected across inductor L. Power source 12 may be, for example, an oscillator having a frequency in the range of about 2–100 MHZ. A load 14 is connected across voltage divider capacitor C2. Load 14 may be, for example, a power resistor.

Dielectric transformer 10 has a configuration similar to that of the feedback circuit of a Colpitts oscillator. Instead of coupling the output to the input of an active element as in the Colpitts oscillator, however, the dielectric transformer operates to transform a power voltage and current to match the impedance of a load.

L is preferably selected to have a high reactance compared to the impedance of power source 12, and C2 is preferably selected to have a low reactance compared to the impedance of load 14, such that the voltage across load 14 may be determined approximately by the equation:

$$V_L = \frac{C1}{C1 + C2} V_{AC}$$

where $V_L$=voltage across load 14, and $V_{AC}$=voltage across power source 12

Once C1 and C2 are selected for the desired voltage transformation, the inductance of tuning inductor L may be selected according to the formula:

$$f = \frac{1}{2\Pi\sqrt{LC}}$$

where f=frequency of power source 12, and

C=(C1)(C2)/(C1+C2)

Figure 2:
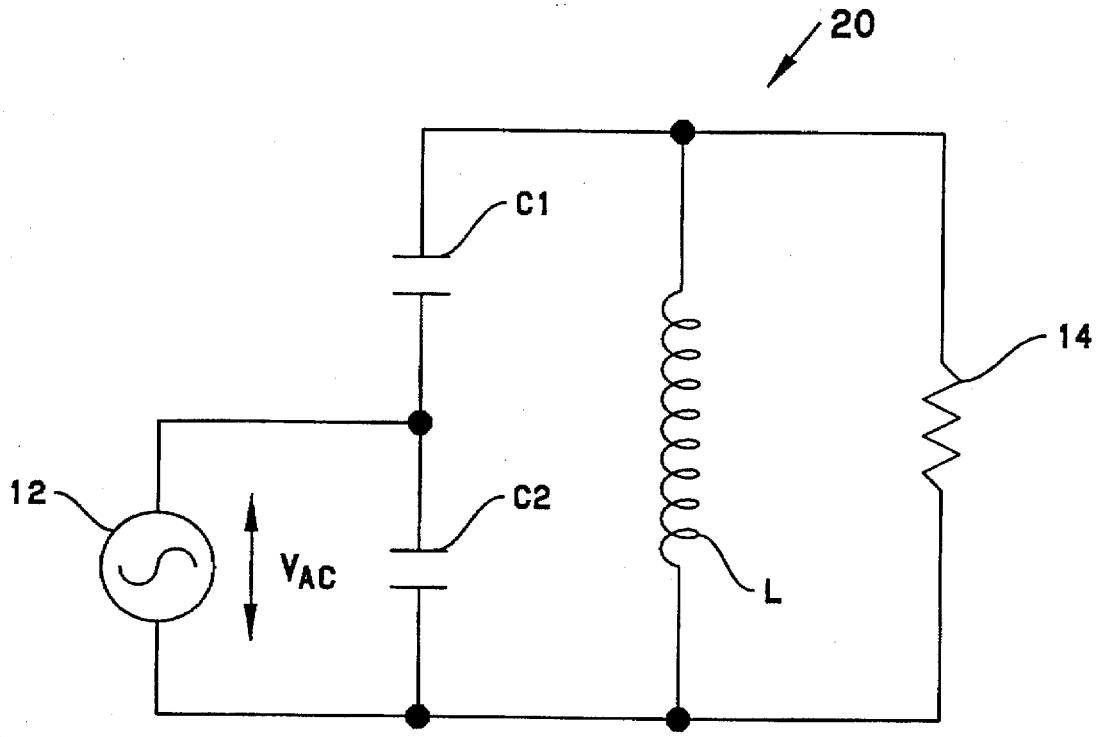
FIG. 2 is an electrical schematic of a voltage step-up dielectric power transformer.

In FIG. 2, a dielectric power transformer 20 for stepping up voltage is shown. In this configuration, power source 12 is connected across capacitor C2 and load 14 is connected across inductor L. The step-up voltage transformation ratio may be determined by:

$$V_L = \frac{C1 + C2}{C1} V_{AC}$$

Figure 3:
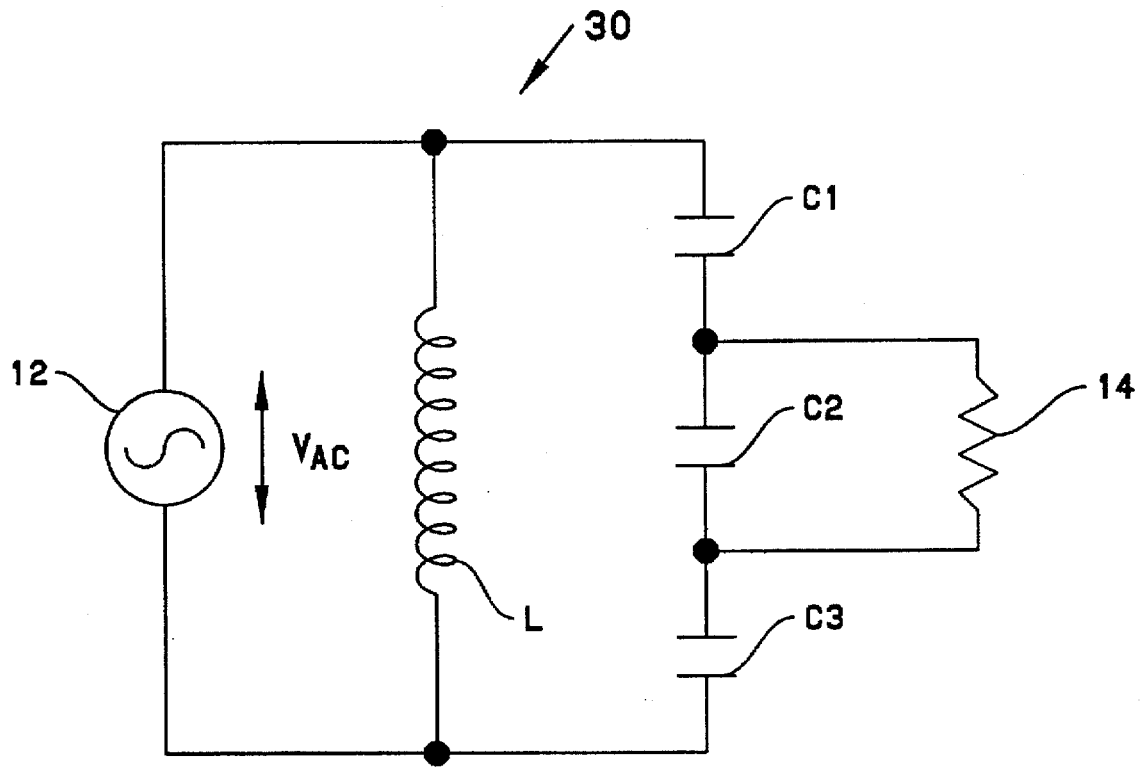
FIG. 3 is an electrical schematic of a voltage step-down dielectric power transformer with DC isolation.

In FIG. 3, a dielectric power transformer 30 is used to provide DC isolation. In this configuration, a third capacitor C3 is used to isolate load 14 from the DC path to power source 12. If C3=C1=2C, then the voltage transformation ratio may be selected using:

$$V_L = \frac{C}{C+C2} V_{AC}$$

If load 14 short-circuits in any of the configurations of FIGS. 1–3, the resonant frequency of the dielectric power transformer is shifted away from the frequency of power source 12. The resulting high reactance of the non-shorted portion of the dielectric transformer between power source 12 and load 14 limits current flow, thus affording virtually instantaneous short-circuit protection to power source 12.

Other modifications, variations, and applications of the present invention may be made in accordance with the above teachings other than as specifically described to practice the invention within the scope of the following claims.

We claim:

1. A dielectric power transformer comprising:

a power source;

a load;

a single tuning inductor having a nonmagnetic core operably coupled to one of said power source and said load; and a capacitive voltage divider connected in parallel with said tuning inductor operably coupled to one of said power source and said load to transform power from said power source to said load.

2. The dielectric power transformer of claim 1, wherein said power source is an alternating current power source operably coupled to said tuning inductor wherein said power source has a frequency substantially equal to a resonant frequency of said tuning inductor and said capacitive voltage divider.

3. The dielectric power transformer of claim 2, wherein said load is operably coupled to said capacitive voltage divider.

4. The dielectric power transformer of claim 1, wherein said power source is an alternating current power source operably coupled to said capacitive voltage divider wherein said power source has a frequency substantially equal to a resonant frequency of said tuning inductor and said capacitive voltage divider.

5. The dielectric power transformer of claim 4 wherein said load is operably coupled to said tuning inductor.

6. The dielectric power transformer of claim 1, wherein said capacitive voltage divider comprises three capacitors connected in series.

7. The dielectric transformer of claim 6 wherein said load is operably coupled to said capacitors to cause direct current flow between said load and said power source to be blocked by at least one of said capacitors.

* * * * *